United States Patent [19]

Marchand

[11] Patent Number: 4,896,792

[45] Date of Patent: Jan. 30, 1990

[54] AUTOMATIC DISPENSING DEVICE FOR PRODUCTS AND CENTRAL WAREHOUSE OR STORE CONSTRUCTED WITH SUCH DEVICES

[76] Inventor: Michel Marchand, 130, Route de Genval, B-1328 Lasne, Belgium

[21] Appl. No.: 224,569

[22] Filed: Jul. 26, 1988

Related U.S. Application Data

[63] Continuation-in-part of Ser. No. 102,271, Sep. 28, 1987, abandoned, which is a continuation of Ser. No. 819,905, Dec. 17, 1985, abandoned.

[51] Int. Cl.[4] ..... G07F 11/12

[52] U.S. Cl. ..... 221/11; 221/103; 221/133; 221/242; 221/251; 221/277; 221/278

[58] Field of Search ..... 221/6, 11, 312 R, 103–109, 221/111, 123, 131, 133, 241, 242, 92, 93, 95, 163, 164, 192, 193, 251, 258, 277, 278, 199, 295, 129, 297–299; 186/55, 56

[56] References Cited

U.S. PATENT DOCUMENTS

| | | | |
|---|---|---|---|
| 1,981,783 | 11/1934 | De Bussey | 186/55 |
| 2,272,682 | 2/1942 | Srodulski | 221/242 X |
| 2,325,165 | 7/1943 | Goodwin | 221/11 |
| 2,353,394 | 7/1944 | Farmer | 221/258 X |
| 2,399,105 | 4/1946 | Donaldson | 221/299 X |
| 2,511,099 | 6/1950 | Case | 221/295 X |
| 2,784,872 | 3/1957 | Lux | 221/277 |
| 2,868,344 | 1/1959 | Shields | 221/258 X |
| 3,053,599 | 9/1962 | Mortara | 221/11 X |
| 3,055,544 | 9/1962 | Krakauer et al. | 221/193 X |
| 3,144,958 | 8/1964 | Gumpertz | 186/56 X |
| 3,313,449 | 4/1967 | Parks | 221/242 X |
| 3,360,163 | 12/1967 | Fessler | 221/277 X |
| 3,361,506 | 1/1968 | Newberry | 221/242 X |
| 3,512,679 | 5/1970 | Stoltz | 221/241 X |
| 3,627,174 | 12/1971 | Baxendale | 221/295 |
| 3,653,541 | 4/1972 | Crum | 221/192 X |
| 3,704,810 | 12/1972 | Sakai | 221/11 X |
| 3,970,216 | 7/1976 | Rainey | 221/295 X |
| 4,013,179 | 3/1977 | Fluck | 221/251 X |

FOREIGN PATENT DOCUMENTS

| | | |
|---|---|---|
| 2029999 | 1/1972 | Fed. Rep. of Germany . |
| 1263815 | 5/1961 | France . |
| 1324460 | 3/1963 | France . |
| 576903 | 6/1976 | Switzerland . |
| 342787 | 2/1931 | United Kingdom . |

*Primary Examiner*—Kevin P. Shaver

*Attorney, Agent, or Firm*—Zarley, McKee, Thomte, Voorhees & Sease

[57] ABSTRACT

An automatic dispensing device for products is provided, and includes a warehouse with a back guide, a front guide, and an intermediate movable guide so as to define product chutes arranged one behind the other. Each chute is adapted to hold a plurality of products, one stacked upon the other. An inclined ramp is provided at the lower end of the product chutes for receiving the products from the chutes. The movable guide is movable between lowered and raised positions to control which chute is in communication with the ramp so that products from only one chute are in communication with the ramp at a given time. A control element is provided on the ramp for automatically releasing one product at a time from the ramp.

10 Claims, 3 Drawing Sheets

AUTOMATIC DISPENSING DEVICE FOR PRODUCTS AND CENTRAL WAREHOUSE OR STORE CONSTRUCTED WITH SUCH DEVICES

This is a continuation-in-part of co-pending application Ser. No. 102,271, filed Sept. 28, 1987 and now abandoned, which in turn was a continuation of application Ser. No. 819,905, filed Dec. 17, 1985, now abandoned.

BACKGROUND OF THE INVENTION

This invention concerns automatic dispensing devices for products. The application of the invention is of particular interest in the field of automatic dispensing of pharmaceutical products from a central warehouse fitted with dispensing devices in accordance with the invention.

Automatic dispensing machines are known, for example, as disclosed by patents EP No. 26,754, U.S. Pat. No. 2,627,941, CH No. 282,314, DE No. 1,449,152 or DE No. 2,313,808.

The purpose of this invention is to provide a dispensing device of simple construction with very high operating reliability.

SUMMARY OF THE INVENTION

The present invention consists of a warehouse laid out substantially vertically and/or sloping downwards and capable of containing a column of products stacked on each other. The lower end of the warehouse is fit with a movable element made so as to be automatically actuated by a unit of the product to be dispensed. This movable element has the capability of acting as a removable stop for the products and/or cooperating with at least one fixed stop positioned close to the movable element. The products are automatically dispensed from the warehouse by the movable element and onto a conveyor belt carrying the dispensed products to a common dispatching station.

Other benefits and special features of the invention will appear from the description of a construction example described below and by referring to the attached drawings.

DETAILED DESCRIPTION OF THE DRAWINGS

Figure 1:
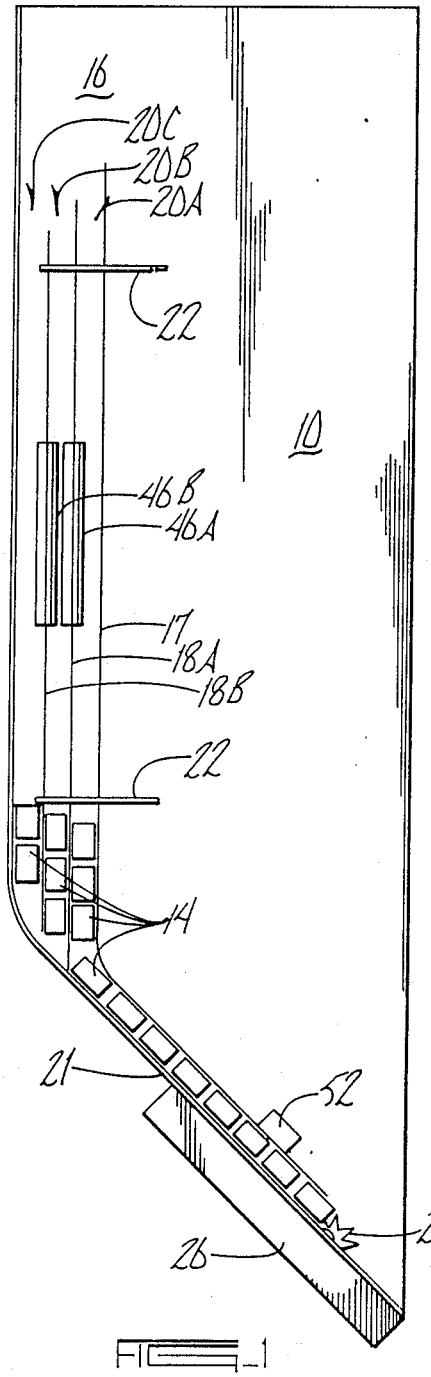
FIG. 1 is a side view of a dispensing device in accordance with the invention.
Figure 2:
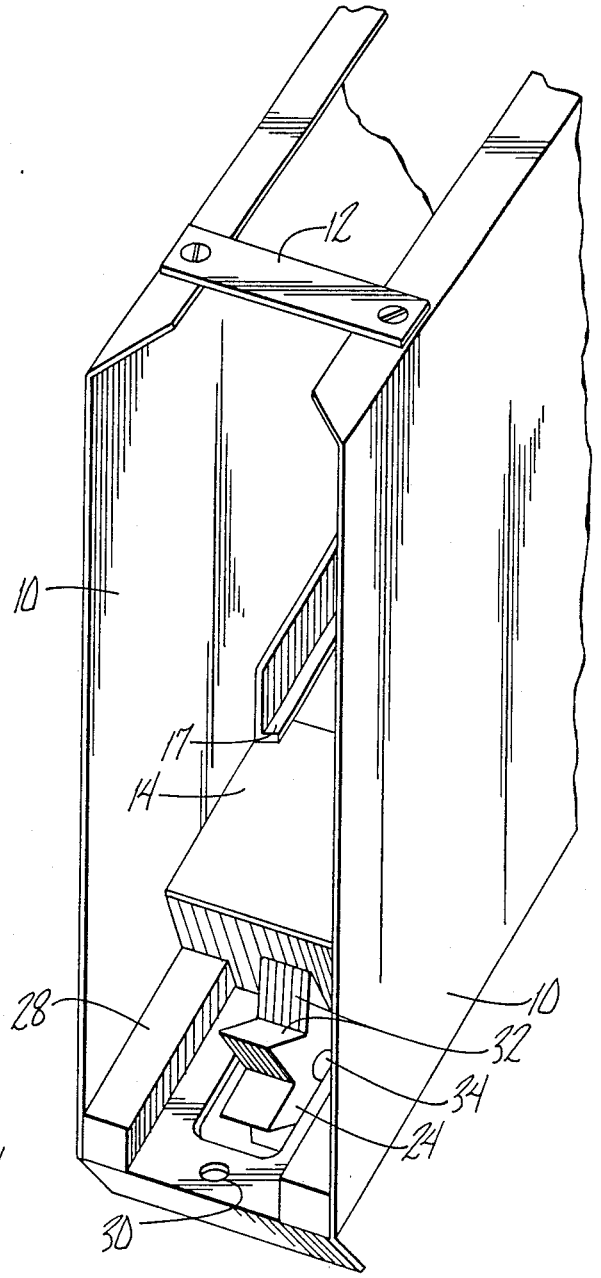
FIG. 2 is a partial perspective view of the lower end of the device.

As shown by FIG. 1 and 2, the dispensing device consists of a warehouse having side walls 10 which are held at a distance by spacers 12. The length of spacers 12 correspond to the width of products 14. The warehouse further includes a back wall 16, front guide 17, and intermediate guides 18A and 18B, so as to define product chutes 20A, 20B and 20C. Chutes 20A–20C all terminate in a single inclined ramp 21.

Guides 17, 18A and 18B are movable so as to allow the adjustment of the depth of chutes 20A, 20B and 20C. To this end, side slots 22 are provided in walls 10 so as to allow the adjustment of the position of guides 17, 18A and 18B, which are held in the selected position by bolts or the like.

In accordance with the invention, the lower end of the warehouse is fitted with a movalbe stopping element 24 forming part of a control unit 26.

As shown in FIG. 2, the stopping element 24 can work with fixed stops 28 located on both sides of element 24, which are particularly useful when the product is large.

Close to the movable stopping element 24, a detector 30 is provided, so as to be able to control the actual passage of a product 14 as well as being able to count the number of product units taken. Detector 30 senses the presence of a unit of product. Detector 30 may be any type of sensor, such as an optical sensor.

Figure 3:
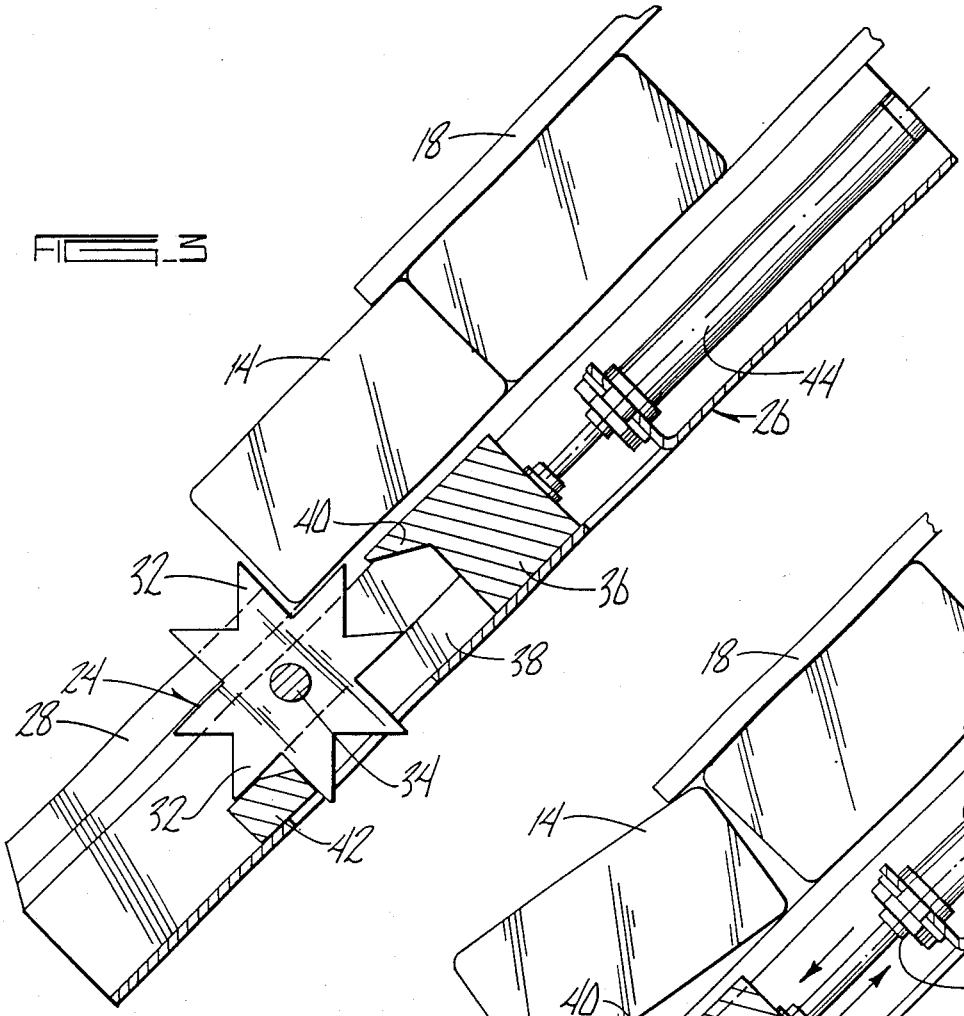
FIGS. 3 and 4 are partial side sectional views showing the operation of the movable stopping element.
Figure 4:
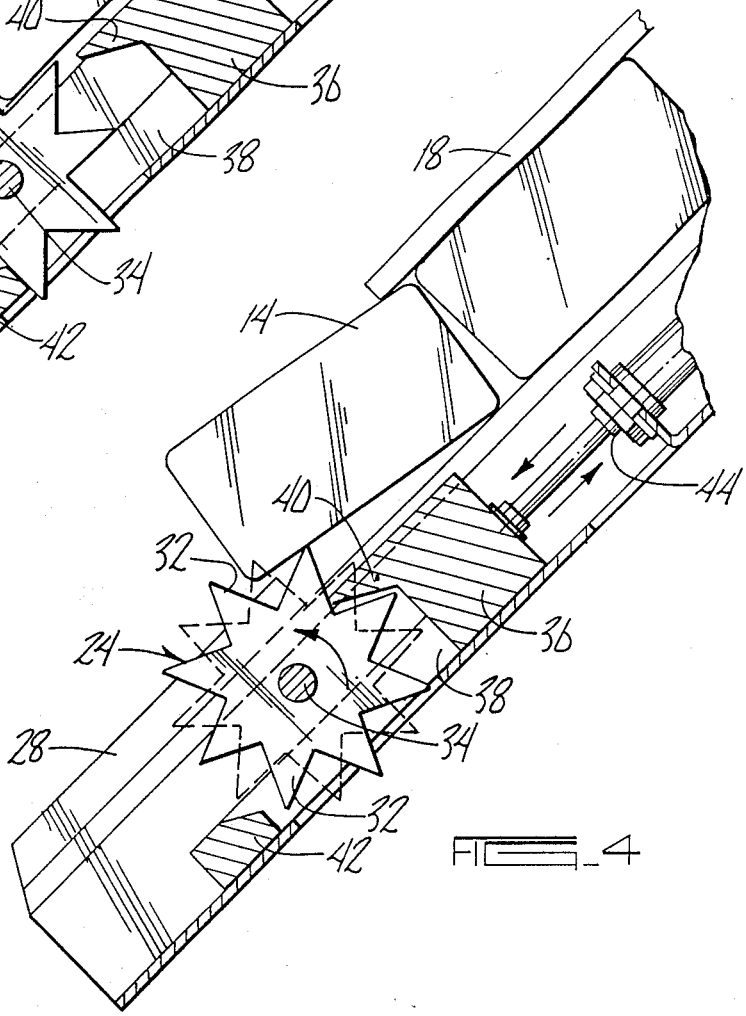

FIGS. 3 and 4 show in greater detail how the control unit 36 of the movable stopping element 24 operates. Element 24 consists of a star-shaped part with a series of peripheral stop notches 32 which can freely rotate on a central pin 34. Rotation of movable element 24 is limited and controlled by a plunger 36 which has a recess 38 in which element 24 can move and which is shaped so as to be capable of acting on element 24 by a to-and-fro movement.

To this end, plunger 36 has on one side of the element 24 a connecting tip 40 and on the other side a locking block 42. The to-and-fro movement can be transmitted to plunger 36 through a pneumatic cylinder 44 or any other suitable means.

In rest or readiness position (FIG. 3), movable stopping element 24 is locked by block 42 which is inserted between two notches 32 of the element. Product 14 is therefore immobilized and held by two diametrically opposed notches 32. In addition, and as shown more clearly in FIG. 2, product 14 is also held at side ends by fixed stops 28.

When an order is executed and a product must be dispensed, cylinder 44 is actuated and imparts a to-and-fro movement to plunger 36 (FIG. 4). During the first or extending movement of plunger 36, connecting tip 40 acts on inclined slope of a notch 32 which is opposite it; considering that block 42 retracts at the same time, movable element 44 is released and can rotate on its pin 34. By this rotation, notch 32 actuated by tip 40 raises product 14 and makes it pass over fixed stops 28 while completely releasing the product so that product 14 drops downwards under its own weight.

In the second or retracting movement of plunger 36, block 42 acts on notch 32 which is opposite it and completes the cycle of limited rotation of stopping element 24 while again locking it between the following two notches 32. At this instant, the dispensing device is again in the readiness position (FIG. 3) blocking the next product 14.

Figure 5:
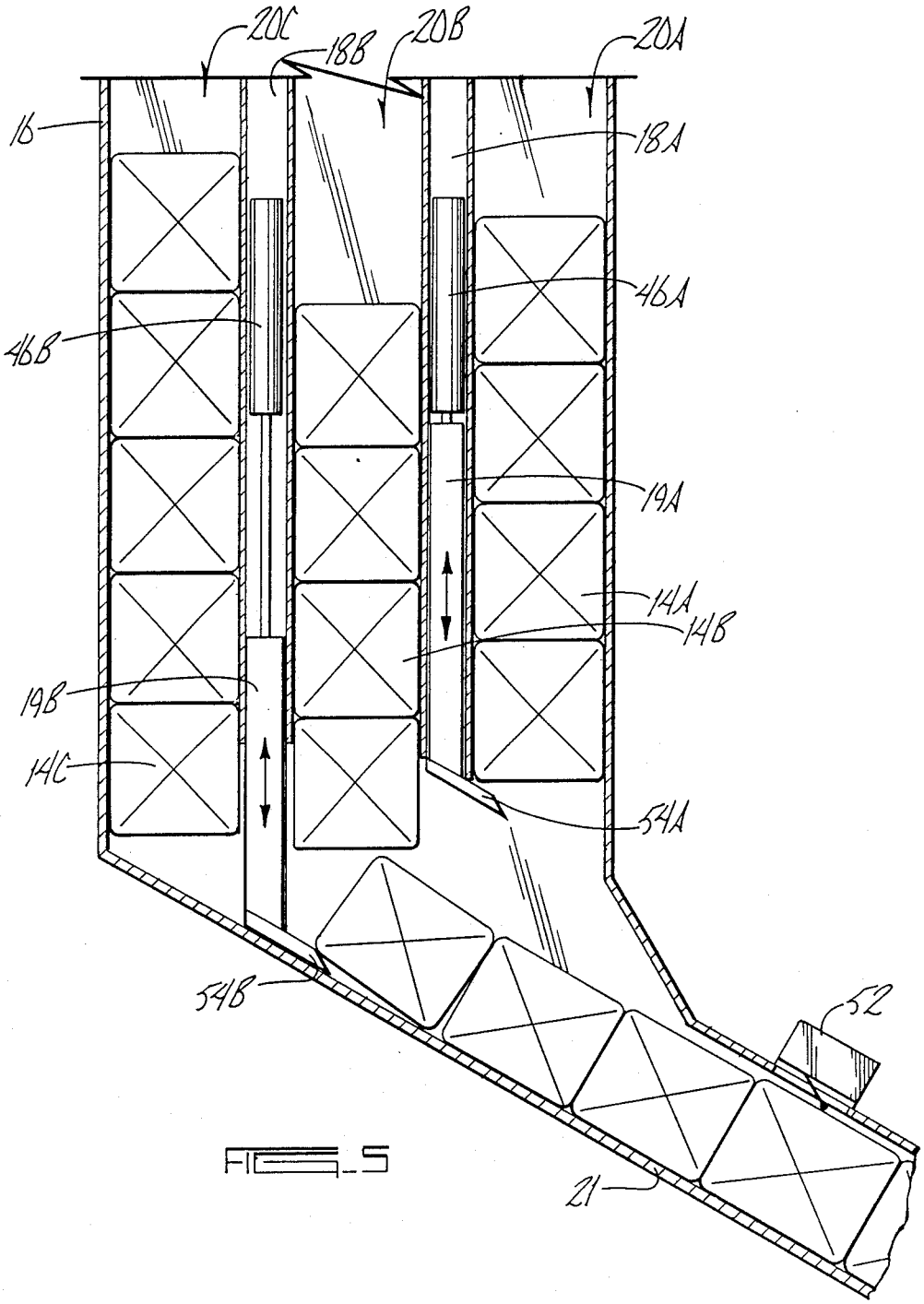
FIG. 5 is enlarged side view similar to FIG. 1.

Guides 18A and 18B have slidable extensions 19A and 19B, respectively, which are vertically movable by microcylinders 46A and 46B, respectively, so as to only release the flow of one column of product at a time to the inclined chute 21. Each microcylinder 46A and 46B can be extended and retracted so as to raise and lower the extensions of guides 18A and 18B, respectively. For example, as shown in FIG. 5, cylinder 46A is raised and cylinder 46B is lowered.

In operation, both guides 18A and 18B are initially lowered so that products 14A within chute 20A are released to ramp 21 for release by element 24. When all of the products within chute 20A are released, a switch 52 mounted in or on ramp 21 senses the absence of products from the ramp, thereby actuating microcylinder 46A which is then retracted to raise guide 18A. With extension 19A raised, products 14B and chute 20B now pass to ramp 21 so as to be dispensed by element 24. When chute 20B is empty, switch 52 actuates cylinder 46B for retraction and raising of extension 18B. With both extensions 19A and 19B raised, products 14C in chute 20C are now free to pass into ramp 21 and subsequent dispensing by element 24.

Guides 18A and 18B each include a projection 54A, 54B, respectively, at the lower end thereof which is inclined at the same angle as ramp 21. When extensions 19A and 19B are raised, projections 54A and 54B serve to catch and hold additional products which are loaded into the respective chute as the next chute is being unloaded onto ramp 21.

It is understood that the sequence of discharge of products from chutes 20A, 20B, and 20C can be reversed or varied from that described above, without departing from the scope of the present invention. Also, multiple warehouses can be positioned side-by-side, with the same or different products in each warehouse.

This new concept of central warehouse or store offers the following benefits:

fast and visual control of the stock and of the general operation;

increased operating reliability of the simplified mechanical units and pneumatic cylinders with very long life;

easy re-stocking even during operation;

easy access to the control and detection units and at the wiring level;

higher execution speed of an order;

greater modularity of arrangement of products; and light construction and high installation flexibility with overall cost reduction of a complete warehouse or store.

What is claimed is:

1. An automatic dispensing device for products, comprising:

a warehouse having opposite side walls, a back guide, a front guide, and at least one movable guide between the front and back guide, said guides being substantially vertically oriented so as to define substantially vertical product chutes arranged one behind another, each chute having a lower outlet end being adapted to hold products stacked one upon another;

an inclined ramp at the lower end of the product chutes for receiving products from the chutes;

said movable guide being movable between a lowered position, wherein communication is prevented between the ramp and the chute behind the movable guide, and a raised position wherein communication is provided between the ramp and the chute behind the movable guide such that products are released on to the chute;

control means on the ramp for automatically releasing one product at a time from the ramp; and power means for selectively moving the movable guide between said lowered and raised positions such that only one chute is in communication with the ramp at any time.

2. The device according to claim 1, wherein the control means consists of a star-shaped part presenting a series of peripheral stop notches being rotatably mounted on a central pin and a sliding plunger for acting on said star-shaped part in first and second positions, said plunger having a first means for maintaining the star-shaped part in a normal stop position when in said first position and a second means to rotate the star-shaped part by one notch causing the release of one product unit and to block the passing of the next product when the plunger is in said second position.

3. The device of claim 1 further comprising means for adjustably mounting said front guide and movable guide between said side walls so that the spacing between said front guide, movable guide and back guide is adjustable to accommodate various sized products.

4. The device of claim 1 wherein said movable guide includes an extendable and retractable extension member operatively connected to the power means for raising and lowering with respect to the outlet end of the chutes.

5. The device of claim 1 wherein said control means includes a movable star-shaped element being rotatably mounted on a central pin, and having a series of peripheral notches for engaging one product to prevent the release of said product.

6. The device of claim 5 wherein said control means further comprises a sliding plunger having means for normally maintaining the star-shaped element in a stop position and for periodically rotating the element by one notch to release one product and block the release of the next product.

7. The device of claim 1 further comprising sensing means for sensing the presence and absence of product on the ramp.

8. The device of claim 7 wherein the sensing means is operatively connected to the power means whereby upon sensing an absence of products on the ramp by the sensing means, the power means is actuated to raise the movable guide so as to provide communication between a product-containing chute behind the movable guide and the ramp.

9. The device of claim 8 wherein the movable guide includes a projection extending forwardly into the forwardly adjacent chute, the projection being adapted to support additional products loaded into the chute when the movable guide is raised and the rearward adjacent chute is in communication with the ramp.

10. The device of claim 9 wherein the projection extends from the movable guide at an angle corresponding to the angle of the ramp such that when the movable guide is lowered, the projection lies substantially flat upon the ramp.

* * * * *